US010633213B2

(12) United States Patent
Beauduin et al.

(10) Patent No.: US 10,633,213 B2
(45) Date of Patent: Apr. 28, 2020

(54) YARN TENSIONING SYSTEM AND METHOD FOR KEEPING A YARN WHICH IS TAKEN FROM A YARN STORAGE SYSTEM TO A YARN TAKE-OFF SYSTEM OF A WEAVING MACHINE UNDER TENSION

(71) Applicant: NV MICHEL VAN DE WIELE, Kortrijk/Marke (BE)

(72) Inventors: Charles Beauduin, Halle (BE); Geert Debuf, Drongen (BE); Hans Desmet, Koolskamp (BE); Koen Bruynoghe, De Pinte (BE); Karl Wyseur, Vichte (BE)

(73) Assignee: NV MICHEL VAN DE WIELE (BE)

( * ) Notice: Subject to any disclaimer, the term of this patent is extended or adjusted under 35 U.S.C. 154(b) by 128 days.

(21) Appl. No.: 15/773,557

(22) PCT Filed: Nov. 2, 2016

(86) PCT No.: PCT/IB2016/056580
§ 371 (c)(1),
(2) Date: May 3, 2018

(87) PCT Pub. No.: WO2017/077454
PCT Pub. Date: May 11, 2017

(65) Prior Publication Data

US 2018/0319618 A1 Nov. 8, 2018

(30) Foreign Application Priority Data

Nov. 3, 2015 (BE) ..... 2015/5716

(51) Int. Cl.
*B65H 23/192* (2006.01)
*B65H 59/18* (2006.01)
(Continued)

(52) U.S. Cl.
CPC ..... *B65H 59/18* (2013.01); *B65H 51/20* (2013.01); *B65H 57/12* (2013.01); *B65H 59/06* (2013.01); *D03D 49/16* (2013.01); *B65H 2701/31* (2013.01)

(58) Field of Classification Search
CPC ..... B65H 2701/31; B65H 59/16; B65H 2515/31; B65H 2515/32; B65H 2515/70;
(Continued)

(56) References Cited

U.S. PATENT DOCUMENTS 1,956,631 A * 5/1934 Snyder ..... B65H 59/06 242/128
2,048,511 A * 7/1936 Newton ..... B65H 57/12 242/128
(Continued)

FOREIGN PATENT DOCUMENTS

DE 2 192 071 A 6/2010
DE 2 192 072 A 6/2010
(Continued)

OTHER PUBLICATIONS

Written Opinion and International Search Report dated Feb. 8, 2017.

*Primary Examiner* — Robert H Muromoto, Jr.
(74) *Attorney, Agent, or Firm* — Fresh IP PLC; Aubrey Y Chen

(57) ABSTRACT

A yarn tensioning system (1) for keeping at least one yarn (2) which is taken from a yarn storage system (3) to a yarn take-off system (4) of a weaving machine under tension, comprising a brake roller (5) around which the yarn (2) is at least partially wound and a motor (6) for supplying a torque to the brake roller (5), which is actuable in generator operation to keep the yarn (2) under tension between the brake roller (5) and the yarn take-off system (4). In addition, a weaving machine comprising such a yarn tensioning
(Continued)

system (1) and a method for keeping at least one yarn (2) under tension which is taken from a yarn storage system to a yarn take-off system.

22 Claims, 4 Drawing Sheets

(51) Int. Cl.

| | |
|---|---|
| ***B65H 51/20*** | (2006.01) |
| ***B65H 57/12*** | (2006.01) |
| ***D03D 49/16*** | (2006.01) |
| ***B65H 59/06*** | (2006.01) |
| *B65H 23/195* | (2006.01) |

(58) Field of Classification Search
CPC ..... B65H 2220/01; B65H 2220/02; B65H 2220/03; B65H 18/10; B65H 23/198; B65H 2555/23; B65H 2555/24; B65H 57/14; B65H 57/24; B65H 59/06; B65H 59/18; B65H 59/22; B65H 59/36; B65H 63/0321; D03D 49/04; D03D 39/00; D03D 39/20; D03D 49/12; D03D 51/28; D02H 13/00; D02H 13/08; D02H 13/24; D02H 1/00
See application file for complete search history.

(56) References Cited

U.S. PATENT DOCUMENTS

| | | | | |
|---|---|---|---|---|
| 2,668,019 | A * | 2/1954 | Holt | B65H 59/18 242/419.9 |
| 2,764,367 | A * | 9/1956 | Brey | D02H 13/00 242/155 R |
| 5,699,837 | A * | 12/1997 | Desmet | D03D 39/16 139/102 |
| 5,743,307 | A * | 4/1998 | Derudder | D03D 49/12 139/110 |
| 6,247,504 | B1 * | 6/2001 | Vermeulen | B65H 59/22 139/368 |
| 6,828,743 | B2 * | 12/2004 | Debuf | B65H 18/10 242/413.1 |
| 8,944,115 | B2 * | 2/2015 | Beauduin | D03D 27/06 139/11 |
| 2003/0015981 | A1 * | 1/2003 | Debuf | B65H 18/10 318/430 |
| 2009/0140094 | A1 * | 6/2009 | Jakob | B65H 59/16 242/410 |
| 2013/0019987 | A1 * | 1/2013 | Beauduin | D03D 27/06 139/21 |

FOREIGN PATENT DOCUMENTS

| | | |
|---|---|---|
| FR | 2 145 056 A | 2/1973 |
| IT | 2 166 135 A1 | 3/2010 |

* cited by examiner

YARN TENSIONING SYSTEM AND METHOD FOR KEEPING A YARN WHICH IS TAKEN FROM A YARN STORAGE SYSTEM TO A YARN TAKE-OFF SYSTEM OF A WEAVING MACHINE UNDER TENSION

The present application claims priority from Belgian Patent Application No. 2015/5716 filed on Nov. 3, 2015, which is incorporated herein by reference.

FIELD OF THE DISCLOSURE

The present disclosure relates to a yarn tensioning system for keeping at least one yarn which is taken from a yarn storage system in a first direction to a yarn take-off system of a weaving machine under tension, comprising a brake roller which is rotatably arranged in the yarn tensioning system and around which the yarn is at least partially wound in order to keep this yarn under tension between the brake roller and the yarn take-off system. In addition, the present disclosure relates to a weaving machine comprising such a yarn tensioning system.

Furthermore, the present disclosure relates to a method for keeping at least one yarn which is taken from a yarn storage system in a first direction to a yarn take-off system of a weaving machine under tension.

BACKGROUND

Yarn tensioning systems and methods for keeping yarn which is taken from a yarn storage system to a yarn take-off system in a weaving machine under tension are used in all kinds of weaving machines, such as inter alia carpet weaving machines, velvet weaving machines, wire weaving machines and flat weaving machines.

In this case, the yarn storage system is typically a bobbin creel. This bobbin creel may in this case be a typical bobbin creel for a weaving machine or a typical bobbin creel for a tufting machine, which is used atypically with a weaving machine. With a typical bobbin creel for a weaving machine, the longitudinal axis of the bobbins is more or less perpendicular to the path to be followed by the yarns and the yarn is taken off along the direction of the path. In this case, the bobbin rotates continuously.

With a typical bobbin creel for a tufting machine, the yarn is taken off in the direction of the longitudinal axis of the bobbin. The bobbin is virtually at a standstill. When supplying yarns to a tufting machine using such a bobbin creel, the yarn is supplied as tensionless as possible, with this yarn being guided in tubes. In order to use such a creel in a weaving machine, after a short piece of tube, weights are for example used to keep the warp threads under tension.

The yarn take-off system may be, for example, the weaving zone in a weaving machine, or may be an intermediate store of yarns, in which the yarns of a bobbin creel are redistributed according to the further desired use in the weaving machine and/or assembled to form new yarns which are gathered at this intermediate store for further use thereof in the weaving machine.

With such weaving machines, it is therefore important to keep the tension of the yarns as uniform as possible in various locations in order thus to be able to process the yarns as evenly as possible in the yarn take-off system. With yarns which are supplied to the weaving zone, the quality of the woven fabric may deteriorate significantly when tensions of these yarns in the weaving zone deviate. Generally, when the tension becomes excessively high, yarns may become damaged or even break, or when the tension becomes excessively low, yarns may become entangled. Not only the thread properties of the yarn, but also the path to be followed by the yarn from the yarn storage system to the yarn take-off system, affect the tension of the yarn at the location of the yarn take-off system.

Various systems are already known for keeping yarns which are taken from a yarn storage system to a yarn take-off system in a weaving machine under tension. Some of these yarn tensioning systems are known, for example from GB 2 428 921 A, GB 2 442 955 A, GB 2 378 188 A and EP 1 077 276 A1.

The yarn tensioning system described in EP 1 077 276 A1 is a yarn tensioning system according to the preamble of the first claim for keeping a warp thread running from a bobbin to a weaving zone of a weaving machine under tension and, if necessary, drawing it back. In this case, the warp thread is arranged over two friction rods. A first brake roller runs over the warp thread between both friction rods. A second brake roller runs over the warp thread between the second friction rod and a guide grid. Weights are suspended from the brake rollers. The weights and the friction rods ensure a tension of the yarn which is as even as possible.

However, a problem of this known yarn tensioning system is that when the characteristics of the warp thread (thickness, flexibility, etc.) change, additional weights have to be hung from said weights in order to adjust the forces exerted by the weights on the warp thread. This is a cumbersome, time-consuming and labour-intensive process, as it has to be carried out for each individual warp thread which is passed from a bobbin to the weaving zone. With a velvet weaving machine, there are on average between 1,000 and 10,000 bobbins in the bobbin creel per metre of machine width, depending on the quality of the woven fabric, and the number of different colours present in the woven fabric, with a face-to-face weaving machine the number of bobbins per metre of machine width may even be as much as 32,000 for high-quality woven fabrics comprising many colours.

SUMMARY

It is an object of embodiments of the present invention to provide a yarn tensioning system and a method for keeping at least one yarn which is taken from a yarn storage system to a yarn take-off system of a weaving machine under tension, which, without such laborious modifications, are suitable for keeping yarns having different and/or varying characteristics under constant tension and this irrespective of the path of the yarn between the yarn storage system and the yarn take-off system.

This object may be achieved by providing a yarn tensioning system for keeping at least one yarn which is taken from a yarn storage system in a first direction to a yarn take-off system of a weaving machine under tension, comprising a brake roller which is rotatably arranged in the yarn tensioning system and around which the yarn is at least partially wound in order to keep this yarn under tension between the brake roller and the yarn take-off system, in which the yarn tensioning system furthermore comprises a motor for supplying a torque to the brake roller, in which said motor is actuable in generator operation to keep the yarn under tension.

By allowing a motor to provide a modifiable torque to the brake roller, it is easier to respond to different and/or varying characteristics of yarns and/or a path modification of the yarn and/or changes in the behaviour of the yarn take-off system. The torque of the motor may, for example, be much lower when the machine is standing still (just sufficient to keep the yarn stretched) than when the machine is working.

An additional problem which occurs when keeping yarns in a weaving machine under tension is that yarn recuperation is often required. Such yarn recuperation may be required, for example, due to shed formation. Yarn recuperation may also be required after a broken yarn has been repaired.

A solution to this additional problem is to ensure that the motor of a yarn tensioning system according an embodiment of to the present invention is actuable in motor operation to recuperate the yarn between the brake roller and the yarn take-off system in a second direction which is opposite to the first direction.

With such a yarn tensioning system by means of which yarn can also be recuperated, it is advantageous that this yarn tensioning system comprises a funnel-shaped guide for guiding the yarn to the brake roller. This funnel-shaped guide takes the yarn near the brake roller in as optimal way as possible. When the motor recuperates the yarn, this funnel-shaped guide collects the surplus of yarn. In this way, no slip is caused on the brake roller during yarn recuperation, so that a good yarn tension can be guaranteed. The recuperated yarn does not get entangled either and does not come into undesirable contact with other components of the yarn tensioning system, which could result in, for example, yarn breakage if, for example in periods when little yarn is used, the same piece of yarn repeatedly rubs over the brake roller.

Such a funnel-shaped guide may take several forms, but always narrows from an inlet opening, in which the yarn arrives in the funnel-shaped guide, to an outlet opening where the yarn is passed from the funnel-shaped guide to the brake roller. This funnel-shaped guide does not necessarily end in a tubular piece. This funnel-shaped guide delimits a cup-shaped cavity so as to be able to collect recuperated yarn in an optimum way in this cup-shaped cavity. As a result of the funnel shape, the yarn is free to bend in the funnel-shaped guide without hampering the surrounding components. In the case of yarn recuperation, the funnel-shaped guide preferably does not limit the yarn with regard to the direction of folding or bending of the yarn. Such a yarn tensioning system is particularly suitable for applications in combination with a yarn feeding system using tubes, in which just enough yarn is provided to be able to weave, and a carpet weaving machine.

An aforesaid yarn tensioning system with a funnel-shaped guide according to an embodiment of the present invention preferably also comprises a tubular guide for guiding the yarn to the funnel-shaped guide. In this case, the yarn is preferably taken to an inlet opening of the funnel-shaped guide via an outlet opening of the tubular guide and the outlet opening of the tubular guide is then preferably smaller than the inlet opening of the funnel-shaped guide.

By means of such a tubular guide, the yarn can be supplied virtually without tension. An additional advantage of such a tubular guide is the fact that the yarns cannot become entangled between themselves or between cables of the yarn tensioning system. Since there is virtually no slip, the length of the used yarn can be calculated very accurately. Accurate knowledge of this length makes it possible to replenish yarn which is about to run out in a targeted and simple way.

In addition to actuating the motor of a yarn tensioning system according to an embodiment of the present invention in the aforesaid motor operation, it may also be useful to provide this motor actuable in motor operation in the first direction, to take additional yarn from the yarn storage system.

A yarn tensioning system according to an embodiment of the present invention may comprise several of said brake rollers with associated motors, in which a brake roller and associated motor may be provided for each yarn to be supplied or for a number of yarns to be supplied together. In the case of several yarns to be supplied, several separate yarn tensioning systems may also be provided, each of which comprises a brake roller with associated motor for keeping at least one of the yarns under tension. In each of these situations, the tension is then preferably individually controllable by providing the motor to be individually actuable. Thus it is possible to ensure a different (desired) tension of the yarn by changing the torque of the motor. It is also possible to anticipate the behaviour of the machine, for example when the machine suddenly demands a lot of yarn (for example in case of a sudden pull on the yarn). A motor with a slightly higher torque can then try to recuperate the yarn slightly more quickly or to counteract slightly more than normal, so that the yarn tension is guaranteed, or if recuperation takes slightly longer than normal, can then reduce the torque of the motor, so that less energy is built up in the brake roller which will then have to be overcome by the machine.

A yarn tensioning system according to an embodiment of the present invention will preferably also comprise a central control unit and preferably then also comprises means for making the energy generated during the generator operation of the motor immediately available to the control unit of the yarn tensioning system.

In order not to let the generated energy dissipate, the yarn tensioning system according to an embodiment of the present invention may alternatively also comprise means for storing the energy generated during the generator operation of the motor, so that the motor is driven by the stored energy during the motor operation of the motor.

A yarn tensioning system according to an embodiment of the present invention furthermore preferably also comprises measuring means for determining the length of the yarn which is taken off by the yarn take-off system. For each brake roller it is possible to calculate the length of the yarns kept under tension by this brake roller from the number of revolutions of the brake roller or the angular rotation of the motor and the diameter of the brake roller without additional length-measuring sensors being required. When the length of the yarn is calculated in this way, the aforesaid measuring means provide the calculating means required for this purpose.

A yarn tensioning system according to an embodiment of the present invention preferably also comprises time monitoring means to keep track of the time during which the motor operates in motor operation to recuperate the yarn and to compare this monitored time with a certain reference value.

As a result thereof, it is also possible to detect yarn breakage without a tension measuring device.

Preferably, a yarn tensioning system according to an embodiment of the present invention also comprises communication means for receiving signals from the yarn take-off system with regard to the operation of the yarn take-off system, measuring means for measuring parameters for the operation of the yarn tensioning system and tension monitoring means for monitoring the parameters for the operation of the yarn tensioning system relative to the signals received from the yarn take-off system. The signals with regard to the operation of the yarn take-off system represent the current state of the yarn take-off system and may relate to the machine being at a standstill, the machine being in operation, the speed of the machine, etc. The tension monitoring means are preferably also provided to predict the expected operation of the yarn tensioning system on the basis of the current state reported by the yarn take-off system. For this purpose, these tension monitoring means then comprise the necessary calculating means.

With such a communication means for receiving signals from the yarn take-off system and with such a tension monitoring means it is also possible to detect large yarn tension without a tension measuring device.

The aforesaid measuring means, calculating means, time monitoring means, communication means and/or tension monitoring means preferably form part of a central control unit of the yarn tensioning system.

Alternatively, these aforesaid measuring means, calculating means, time monitoring means, communication means and/or tension monitoring means may also form part of an individual motor control unit.

A further preferred embodiment of a yarn tensioning system according to an embodiment of the present invention comprises a tension measuring device for measuring the yarn tension. This makes it possible to determine the yarn tension more accurately.

By measuring the yarn tension, it is also possible to provide different additional detection systems. Thus, it is for example not only possible to detect, based on the measured yarn tension, yarn breakage and/or overtensioning of the yarn, but also irregularities or knots in the yarn.

A yarn tensioning system according to an embodiment of the present invention furthermore preferably also comprises one or more indicating means for generating a signal regarding the length of the yarn taken off and/or the determined and/or measured yarn tension and/or when, based on the state of the yarn take-off system, the motor is actuated in motor operation to recuperate yarn for longer than expected and/or when the brake roller is at a standstill while the yarn take-off system is taking off yarn, etc.

A particular embodiment of a yarn tensioning system according to the present invention comprises actuating means for actuating the motor on the basis of the yarn tension measured by the tension measuring device and communication means for communicating the measured yarn tension from the tension measuring device to the actuating means.

A particularly preferred yarn tensioning system according to an embodiment of the present invention comprises an aforesaid brake roller and an aforesaid motor for each yarn taken from the yarn storage system, so that each yarn can be individually kept under tension.

Alternatively, it is also possible, for example, to use the same brake roller to keep several yarns having identical yarn characteristics and following the same path under tension.

The motor of a yarn tensioning system according to an embodiment of the present invention is preferably a DC motor or a brushless AC motor. More preferably, this motor is a brushless DC motor, still more preferably a brushless DC motor having an external rotor (a type of motor in which the stator is stationary and the rotor rotates) provided with HALL sensors, preferably carried out as a pancake motor, due to the compactness of such a type of motor, the economic feasibility and considering little energy is released or little energy is required in the present application.

By minimizing the slip of the yarn on the brake roller, the tension of the yarn can be kept constant, irrespective of the thread characteristics, and the accuracy of any measurements can be increased. There are various ways of reducing slip of the yarn on the brake roller.

A specific embodiment of a yarn tensioning system according to the present invention comprises therefor a tension roller which is arranged in a clamped manner against the brake roller in the yarn tensioning system to clamp the yarn between the brake roller and the tension roller.

Alternatively or additionally, the brake roller may for this purpose be provided for winding the yarn around it several times.

Furthermore alternatively or additionally, the yarn tensioning system may comprise a braking device for braking the yarn in order to prevent the yarn from slipping on the brake roller.

Still alternatively or additionally, the brake roller may comprise a running surface for at least partially winding the yarn around it, in which this running surface is provided with an anti-slip layer and/or with a profiling.

An object of embodiments of the present invention may furthermore be achieved by providing a weaving machine, comprising a yarn storage system, a yarn take-off system for taking yarn from the yarn storage system and a yarn tensioning system to keep a yarn which has been taken from the yarn storage system by the yarn take-off system under tension between the yarn tensioning system and the yarn take-off system, in which the yarn tensioning system is an above-described yarn tensioning system according to an embodiment of the present invention.

In addition, this object may be achieved by providing a method for keeping at least one yarn which is taken from a yarn storage system in a first direction to a yarn take-off system of a weaving machine under tension, in which the yarn is at least partially wound around a brake roller which is rotatably arranged in the yarn tensioning system to keep this yarn under tension between the brake roller and the yarn take-off system, in which a motor is actuated in generator operation to drive the brake roller around which the yarn is at least partially wound, to keep the yarn under tension.

Preferably, with such a method, the motor is also actuated in motor operation to drive the brake roller to recuperate the yarn between the brake roller and the yarn take-off system in a second direction which is opposite to the first direction.

Such a method furthermore preferably also comprises monitoring the time during which the motor is actuated in motor operation to recuperate the yarn and generating an indication when this time exceeds a certain reference value. With such a method, it is then possible to detect yarn breakage even without a tension measuring device.

A method according to an embodiment of the present invention furthermore preferably also comprises generating an indication when the brake roller is at a standstill at a point in time when the yarn take-off system takes off yarn. By means of such a method, it is then possible to detect overtensioning of the yarn even without a tension measuring device.

A particularly preferred method according to an embodiment of the present invention also comprises measuring the yarn tension and actuating the motor on the basis of the measured yarn tension.

An additional object of embodiments of the present invention may be achieved by means of such a method according to an embodiment of the present invention in which the motor is actuated in motor operation on the basis of the measured yarn tension to drive the brake roller to recuperate the yarn between the brake roller and the yarn take-off system in a second direction which is opposite to the first direction.

BRIEF DESCRIPTION OF THE DRAWINGS

The present invention will now be explained in more detail by means of the following detailed description of an embodiment of a yarn tensioning system and a method according to the present invention. The sole aim of this description is to give illustrative examples and to indicate further advantages and particulars of the present invention, and can therefore by no means be interpreted as a limitation of the area of application of the invention or of the patent rights defined in the claims.

In this detailed description, reference numerals are used to refer to the attached drawings, in which.

DETAILED DESCRIPTION OF EMBODIMENTS

The figures show some examples of yarn tensioning systems (1) according to embodiments of the present invention.

These yarn tensioning systems (1) each comprise, for each yarn (2) to be tensioned, a brake roller (5) which is rotatably arranged and a motor (6) for supplying a torque to the brake roller (5).

Figure 1:
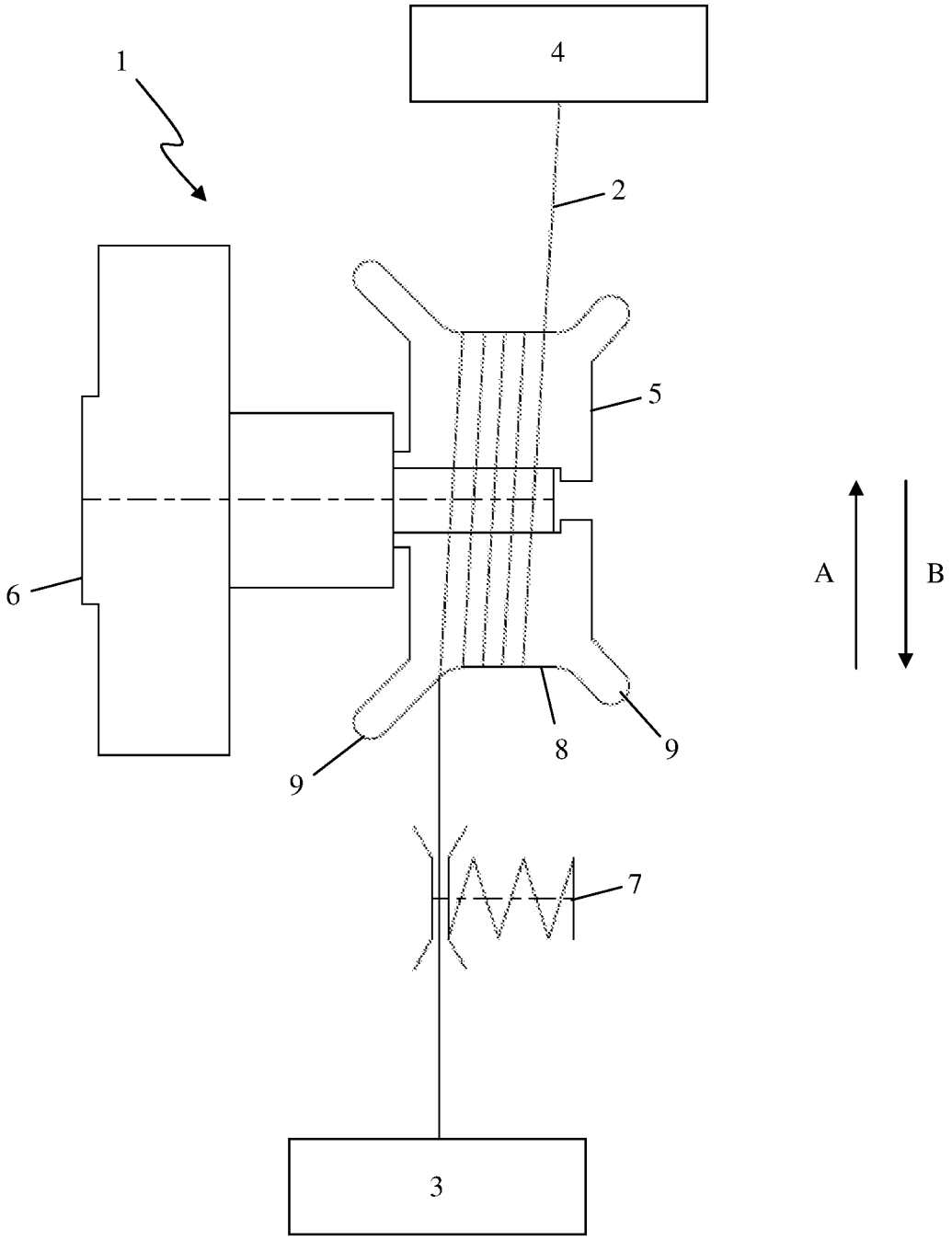
FIG. 1 diagrammatically shows a first embodiment of a yarn tensioning system according to the present invention in side view with a yarn which is taken from a yarn storage system in a first direction to a yarn take-off system of a weaving machine or is recuperated in a second direction, opposite to the first direction, between the yarn tensioning system and the yarn take-off system.

In the first embodiment illustrated in FIG. 1, a yarn (2) taken from a yarn storage system (3) in a first direction (A) to a yarn take-off system (4) of a weaving machine, or recuperated in a second direction (B), opposite to the first direction (A), between the brake roller (5) and the yarn take-off system (4), is wound several times around the brake roller (5) to limit slipping of the yarn (2) with respect to the brake roller (5).

In order to further limit slipping of the yarn (2) with respect to the brake roller (5), this yarn tensioning system (1) furthermore comprises a braking device (7) which is arranged between the yarn storage system (3) and the brake roller (5).

In order to prevent the yarn (2) from running off the brake roller (5), the brake roller (5) is provided with flanges (9) which limit the running surface (8) for the yarn (2). The running surface (8) of this brake roller (5) may be provided with an anti-slip layer by coating it, for example with rubber.

Figure 2:
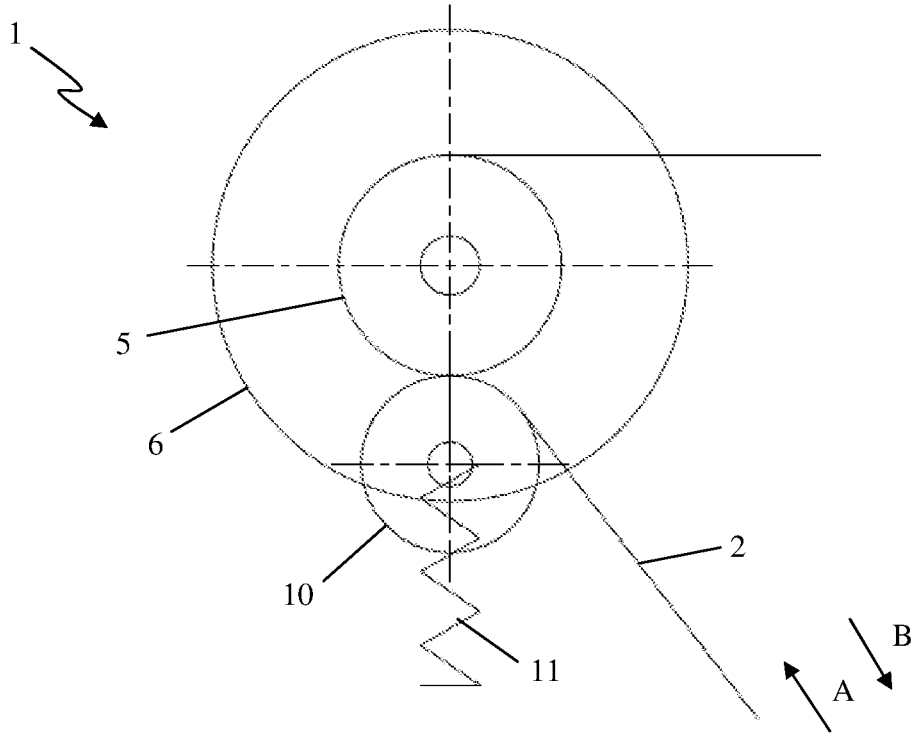
FIG. 2 diagrammatically shows a second embodiment of a yarn tensioning system according to the present invention in front view.
Figure 3:
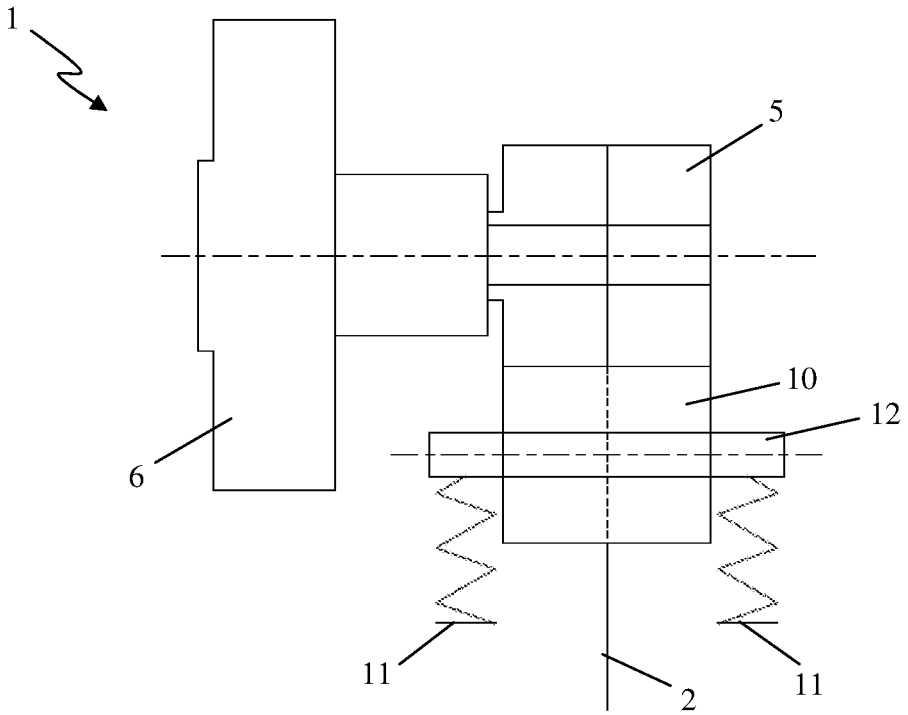
FIG. 3 shows the yarn tensioning system from FIG. 2 in side view.

In the second embodiment, which is illustrated in FIGS. 2 and 3, the yarn tensioning system (1) comprises a tension roller (10). In order to limit slipping of the yarn (2) with respect to the brake roller (5), springs (11) push the shaft (12) of this tension roller (10) towards the brake roller (5), so that the tension roller (10) is arranged in a clamped manner against the brake roller (5) to clamp the yarn (2) between the brake roller (5) and the tension roller (10).

Figure 4:
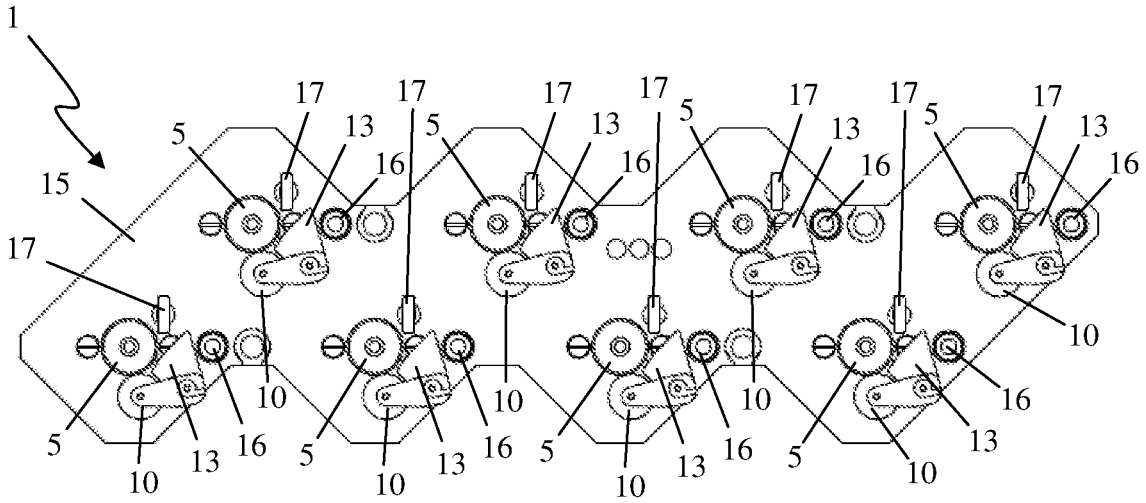
FIG. 4 shows a third embodiment of a yarn tensioning system according to the present invention in front view, without yarn.
Figure 5:
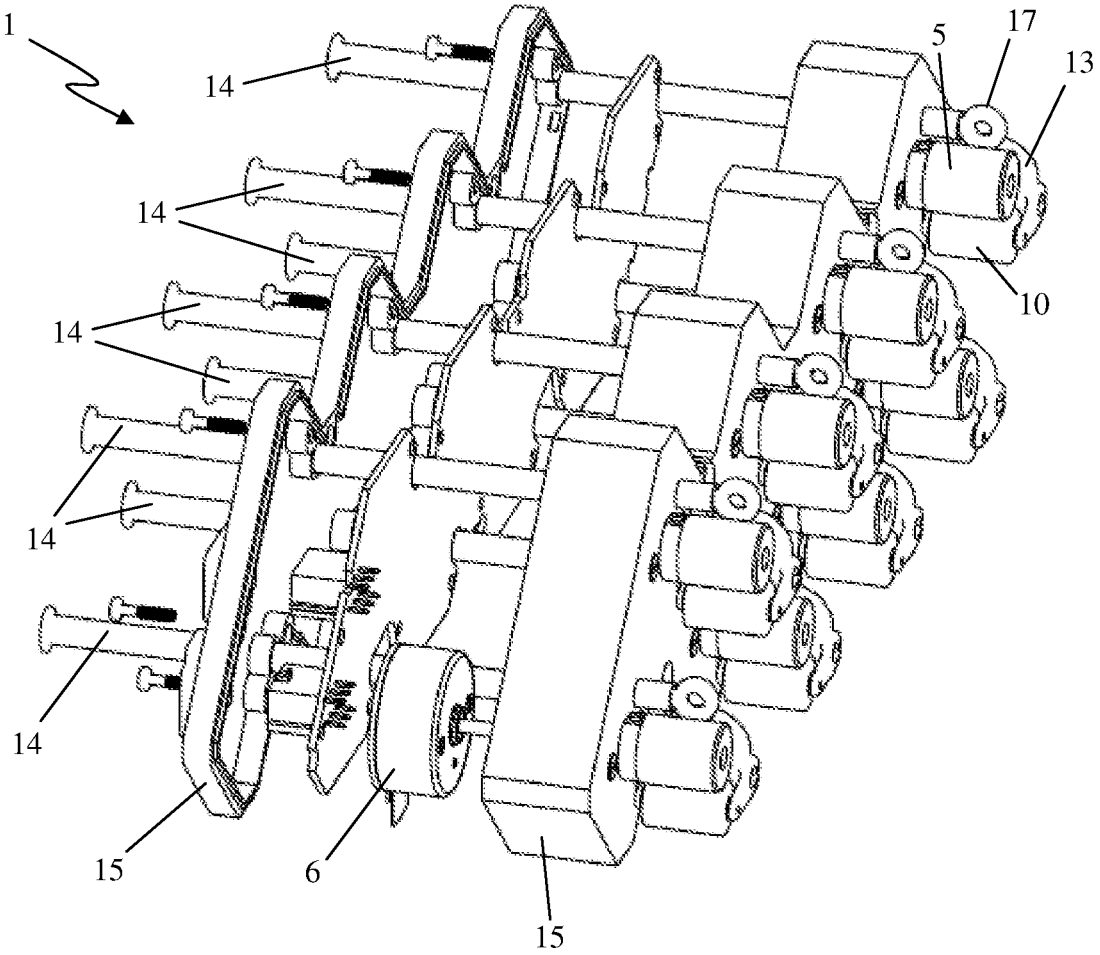
FIG. 5 shows the yarn tensioning system from FIG. 4 partially in cutaway perspective view, without yarn.
Figure 6:
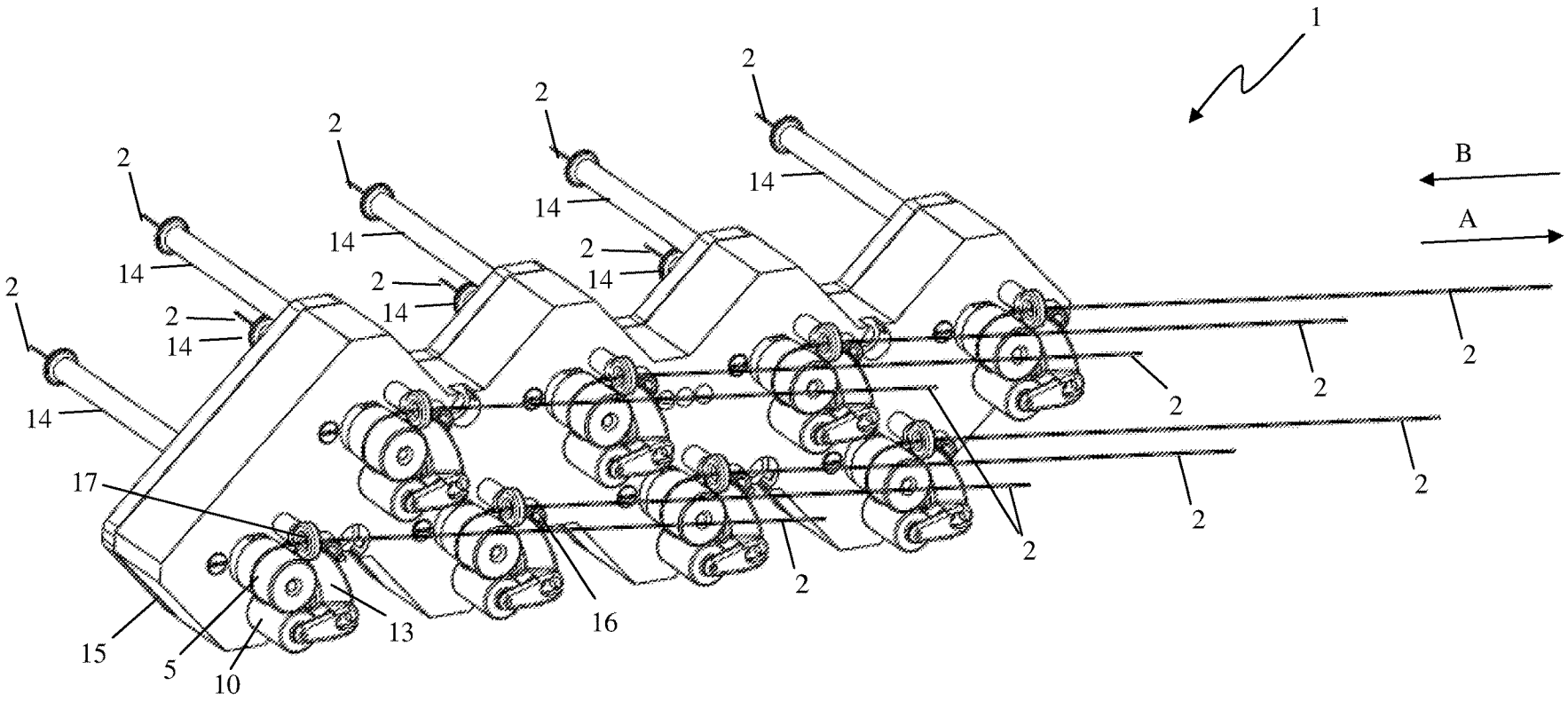
FIG. 6 shows the yarn tensioning system from FIG. 4 in perspective with yarn that is herewith tensioned.

In the third embodiment, which is illustrated in FIGS. 4 to 6, the yarn tensioning system (1) is configured to keep 8 yarns (2) under tension. These yarns (2) may be, for example, warp threads (2) which are fed to a carpet weaving machine as yarn take-off system (4). To this end, the yarn tensioning system (1) comprises a brake roller (5), a motor (6) and a tension roller (10) as in the second embodiment for each yarn (2). For the sake of clarity of the figures, only one motor (6) is shown. Each yarn (2) is fed through a holder (15) via a corresponding tubular guide (14) and is passed to the corresponding brake roller (5) via a funnel-shaped guide (13), wound around this brake roller (5) and fed to the yarn take-off system in a first direction (A) through an eyelet (17). The outlet opening (16) of the tubular guide (14) is smaller than the inlet opening to the funnel-shaped guide (13). The funnel-shaped guide (13) comprises a cup-shaped cavity in which the yarn (2) is collected in the case of yarn recuperation in a second direction (B).

In all illustrated embodiments, the motor (6) is a pancake motor (6) which is configured to supply a torque to the brake roller (5). On the one hand, the motor (6) is actuated in generator operation to keep the yarn (2) under tension. On the other hand, the motor (6) is actuated in motor operation to recuperate the yarn (2) between the brake roller (5) and the yarn take-off system (4) in a second direction (B), which is opposite to the first direction (A).

The yarn tensioning systems (1) comprise a central control unit (not shown) and means for immediately making the energy generated during the generator operation of the motor (6) available to this central control unit of the yarn tensioning system (1). Alternatively, the yarn tensioning systems (1) could comprise means for storing energy generated during the generator operation of the motor (6), so that during the motor operation of the motor (6), the motor (6) is driven by means of the stored energy.

Preferably, the yarn tensioning systems (1) also comprise a tension measuring device (not shown) for measuring the yarn tension. This measured yarn tension is then communicated to actuating means for actuating the motor (6), preferably by means of communication means, so that this motor (6) can be actuated on the basis thereof. In addition, the yarn tensioning systems (1) may comprise indicating means for generating a signal with regard to the measured yarn tension and communication means for communicating the measured yarn tension of the tension measuring device to these indicating means.

By means of the speed of the motor (6) and the diameter of the brake roller (5), the length of the yarn (2) which is taken off by the yarn take-off system (4) can be easily determined.

The invention claimed is:

1. Yarn tensioning system for keeping at least one yarn which is taken from a yarn storage system in a first direction to a yarn take-off system of a weaving machine under tension, comprising:

a brake roller which is rotatably arranged in the yarn tensioning system and around which the at least one yarn is at least partially wound in order to keep the at least one yarn under tension between the brake roller and the yarn take-off system, wherein the yarn tensioning system comprises a motor for supplying a torque to the brake roller, wherein the motor is actuable in generator operation to keep the at least one yarn under tension, and wherein the motor is actuable in motor operation to recuperate the at least one yarn between the brake roller and the yarn take-off system in a second direction which is opposite to the first direction, and a time monitor to keep track of a time during which the motor operates in motor operation to recuperate the at least one yarn and to compare the time with a certain reference value, the yarn tensioning system thereby allowing a user to detect breakage of the at least one yarn without using a tension measuring device.

2. Yarn tensioning system according to claim 1, characterized in that the yarn tensioning system comprises a funnel-shaped guide for guiding the yarn to the brake roller.

3. Yarn tensioning system according to claim 2, characterized in that the yarn tensioning system comprises a tubular guide for guiding the yarn to the funnel-shaped guide.

4. Yarn tensioning system according to claim 1, characterized in that the motor is individually actuable.

5. Yarn tensioning system according to claim 1, characterized in that the yarn tensioning system comprises a central control unit and means for making the energy generated during the generator operation of the motor immediately available to this control unit of the yarn tensioning system.

6. Yarn tensioning system according to claim 1, characterized in that the yarn tensioning system comprises energy storage for storing the energy generated during the generator operation of the motor, so that the motor is driven by the stored energy during the motor operation of the motor.

7. Yarn tensioning system according to claim 1, characterized in that the yarn tensioning system comprises a measure for determining the length of the yarn which is taken off by the yarn take-off system.

8. Yarn tensioning system according to claim 1, characterized in that the yarn tensioning system comprises a communicator for receiving signals from the yarn take-off system with regard to the operation of the yarn take-off system, comprises a measurer for measuring parameters for the operation of the yarn tensioning system and comprises a tension monitor for monitoring the parameters for the operation of the yarn tensioning system relative to the received signals of the yarn take-off system.

9. Yarn tensioning system according to claim 1, characterized in that the yarn tensioning system comprises a tension measuring device for measuring the yarn tension.

10. Yarn tensioning system according to claim 9, characterized in that the yarn tensioning system comprises an actuator for actuating the motor on the basis of the yarn tension measured using the tension measuring device and communicator for communicating the measured yarn tension from the tension measuring device to the actuator.

11. Yarn tensioning system according to claim 1, characterized in that the yarn tensioning system comprises a said brake roller and a said motor for each yarn taken from the yarn storage system.

12. Yarn tensioning system according to claim 1, characterized in that the motor is a pancake motor.

13. Yarn tensioning system according to claim 1, characterized in that the yarn tensioning system comprises a tension roller which is arranged in a clamped manner against the brake roller in the yarn tensioning system to clamp the yarn between the brake roller and the tension roller.

14. Yarn tensioning system according to claim 1, characterized in that the brake roller is provided for winding the yarn several times around it.

15. Yarn tensioning system according to claim 1, characterized in that the yarn tensioning system comprises a braking device for braking the yarn in order to prevent the yarn from slipping on the brake roller.

16. Yarn tensioning system according to claim 1, characterized in that the brake roller comprises a running surface for at least partially winding the yarn around it, in which said running surface is provided with an anti-slip layer and/or with a profiling.

17. Weaving machine, comprising a yarn storage system, a yarn take-off system for taking yarn from the yarn storage system and a yarn tensioning system to keep a yarn which has been taken from the yarn storage system by the yarn take-off system under tension between the yarn tensioning system and the yarn take-off system, wherein the yarn tensioning system is a yarn tensioning system according to claim 1.

18. Method for keeping at least one yarn which is taken from a yarn storage system in a first direction to a yarn take-off system of a weaving machine under tension, in which the at least one yarn is at least partially wound around a brake roller which is rotatably arranged in the yarn tensioning system to keep the at least one yarn under tension between the brake roller and the yarn take-off system, wherein a motor is actuated in generator operation to drive the brake roller around which the at least one yarn is at least partially wound, to keep the at least one yarn under tension, wherein the motor is actuated in motor operation to drive the brake roller to recuperate the at least one yarn between the brake roller and the yarn take-off system in a second direction, which is opposite to the first direction, and further comprising:

monitoring a time during which the motor is actuated in motor operation to recuperate the at least one yarn and generating an indication when the time exceeds a certain reference value, the method thereby allowing a user to detect breakage of the at least one yarn without using a tension measuring device.

19. Method according to claim 18, characterized in that said method comprises generating an indication when the brake roller is at a standstill at a point in time when the yarn take-off system takes off yarn.

20. Method according to claim 18, characterized in that said method comprises measuring the yarn tension and actuating the motor on the basis of the measured yarn tension.

21. Yarn tensioning system according to claim 2, characterized in that the funnel-shaped guide comprises a top open end and a bottom open end, wherein the top open end is wider than the bottom open end.

22. Yarn tensioning system according to claim 3, characterized in that the funnel-shaped guide comprises a top open end and a bottom open end, wherein the top open end is wider than the bottom open end.

* * * * *